United States Patent [19]

Temple et al.

[11] 4,143,685

[45] Mar. 13, 1979

[54] WEAVING LOOMS

[75] Inventors: Stephen Temple; Anthony D. Paton, both of Cambridge, England

[73] Assignee: Cambridge Consultants Limited, Cambridge, England

[21] Appl. No.: 827,173

[22] Filed: Aug. 24, 1977

[30] Foreign Application Priority Data

Sep. 1, 1976 [GB] United Kingdom ..... 36212/76

[51] Int. Cl.[2] ..... D03C 13/00; D03D 47/26

[52] U.S. Cl. ..... 139/456; 139/436; 139/188 R

[58] Field of Search ..... 139/11, 35, 55.1, 436, 139/188, 456

[56] References Cited

U.S. PATENT DOCUMENTS

| | | | |
|---|---|---|---|
| 1,316,159 | 9/1919 | Jackson | 139/188 |
| 3,343,569 | 9/1967 | Barr | 139/11 |
| 3,881,523 | 5/1975 | Paton et al. | 139/436 |

*Primary Examiner*—Henry Jaudon

*Attorney, Agent, or Firm*—Bertram Frank

[57] ABSTRACT

A loom in which each warp yarn passes through a retraction region and a shedding region, and in which means are provided for creating gaseous fluid flow along each warp yarn so that the yarns, or those that are not otherwise restrained, are moved to form a loop in the shedding region, the loops, or selected ones of them, being separated from the warp yarn sheet by gaseous fluid flow to form a shed, and means are provided for mechanically displacing portions of the yarns in the retraction region to move the yarns longitudinally into a path of predetermined length so as to draw the yarns into tension in the shedding region to close the shed. The means for drawing the yarns into tension may also be employed to draw the fell of the woven fabric against a fixed reed to beat up the inserted weft yarn.

24 Claims, 11 Drawing Figures

WEAVING LOOMS

Figure 1A:
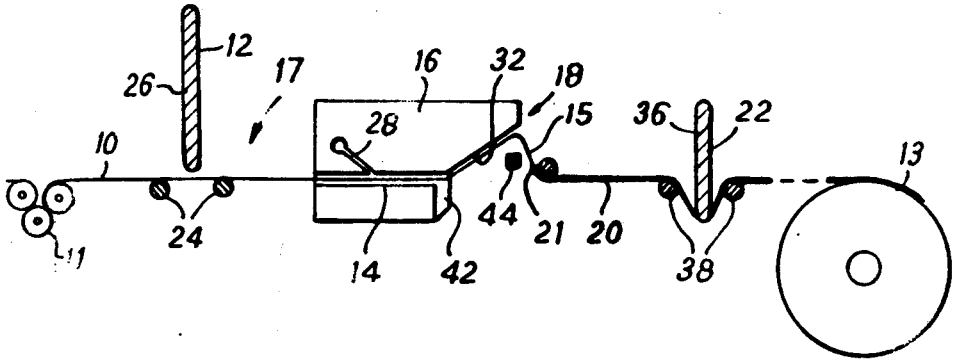

This invention relates to weaving looms.

Many attempts have been made to increase the speed of operation of looms. Hitherto, increases in speed of operation have been obtained by increasing the speed of weft insertion, as for example by increasing the velocity of weft insertion in the rapier, gripper-shuttle and jet looms or by providing multiple weft insertion in so-called travelling wave shed looms in which the warp yarns are shed successively in a wave motion in the loom with each shuttle or weft carrier moving in synchronism with the shedding wave. Developments of weft insertion have reached a limit, so that significant increases in the overall speed of operation of the loom can only be achieved by development of other aspects of the weaving operation such as shedding. In conventional looms, the comparatively high inertia of recriprocating mechanical shedding devices such as healds places a limit on the speed of the shedding operation.

It has been proposed in United Kingdom patent specification No. 1,436,541 to provide a loom in which a length of each warp yarn in the warp yarn sheet is held with a predetermined amount of slack and the length of yarn is moved alternately in opposite directions by means of fluidic forces so that the slack is formed alternately in a shedding area and in a second location remote from the shedding area, the slack yarn in the shedding area being separated from the yarn sheet to form a shed. It has been found with the proposed loom that in some conditions of operation problems are arisen owing to the difficulty of precisely controlling the movements of the warp yarns and the tension distribution in those yarns.

It is an object of the present invention to provide an improved loom.

According to this invention there is provided a loom comprising means for feeding a plurality of warp yarns to a shedding region and take-up means for drawing woven fabric from the shedding region, each warp yarn passing through a retraction region and the shedding region, means for creating gaseous fluid flow along one or more portions of each of the warp yarns so that unrestrained yarns along which the fluid flow is created are moved longitudinally in a first direction to form a loop in each of those yarns in the shedding region, and means for mechanically displacing portions of warp yarns in the retraction region thereby to move the yarns longitudinally in a second direction into a path of predetermined length to draw the yarns into tension in the shedding region, means for separating the loops of yarn from the warp yarn sheet in the shedding region to form a shed for the insertion of a weft yarn, weft insertion means for inserting a weft yarn into the shed, and beating means for beating the inserted weft yarn against the fell of the woven fabric.

The term "yarn" is intended to embrace monofilament yarns as well as multifilament or fibrous spun yarns or threads, and flat tape-like yarns such as are used in woven backing fabrics for carpets.

In one form of the invention, the means for creating gaseous fluid flow is adapted to create fluid flow simultaneously along the warp yarns in at least one section of the loom during a shedding operation, and there is provided a plurality of means for mechanically displacing portions of selected warp yarns each arranged to act on a group of the warp yarns during the shedding operation thereby to inhibit shedding of the yarns in that group, so that the necessary control of shedding selection can be effected.

In another form of the invention, the means for creating gaseous fluid flow is adapted to create fluid flow simultaneously along all the warp yarns in at least one section of the loom during a shedding operation thereby to transfer the loops in all the warp yarns to the shedding region, and shedding control means are provided to control the means for separating warp yarn loops from the yarn sheet in the shedding area so that in each cycle of operation selected ones of the warp yarn loops are positioned on one side of the plane defined by the tensioned warp yarns, whilst the remainder of the warp yarns are positioned on the opposite side of that plane, thereby to form a shed. The means for separating the warp yarn loops in the shedding area from the warp yarn sheet preferably comprise means for controlling gaseous fluid flow in the shedding area so that the fluid flow acts on the loops to separate them from the warp yarn sheet. The means for creating gaseous fluid flow along one or more portions of each warp yarn may comprise an element having a surface formed with parallel grooves each adapted to accommodate a warp yarn and means for supplying fluid to the grooves to create fluid flow along the grooves in the said first direction.

Alternatively, the warp yarns may pass through channels to which fluid under pressure can be supplied so as to flow along the channels to provide the force on the yarns.

The beating means preferably comprises a stationary reed through or over which the warp yarns pass, and means for mechanically displacing portions of the warp yarns in a region remote from the shedding region, into a path of predetermined length, after the warp yarns have been drawn into tension in the shedding region, thereby to move the warp yarn sheet so as to draw the fell of the woven fabric against the reed to beat the inserted weft yarn, and there are provided means for returning the fell to its original position after the beating operation.

If the loom is provided, as mentioned above, with an element having on opposite sides thereof two surfaces each formed with parallel grooves each adapted to accommodate one of the warp yarns, the grooves in each surface may be transversely staggered relative to the grooves in the other surface and arranged to receive alternate ones of the warp yarns, and the two grooved surfaces may be arranged to meet one another in such a manner as to form a narrow zig-zag face extending transversely across the loom and forming the reed against which the fell of the fabric is drawn to beat up the inserted weft yarn.

Advantageously, the or each means for mechanically displacing portions of the selected warp yarns comprises a pair of guide members spaced apart along the length of the yarns and over which each of the yarns is drawn, and a movable detent adapted to engage each of the warp yarns at a point between the two guide members and to move each yarn out of the warp yarn sheet to create a loop of yarn of predetermined length between the guide members.

The detent may comprise a rotor rotatable about an axis parallel to the direction of weft insertion and having a surface engaging the warp yarns and shaped so that on rotation each warp yarn is displaced by an amount dependent on the angular position of the rotor.

In one form of the invention, the warp yarn sheet is divided into a number of separate yarn sheets, and a separate rotor is provided for each yarn sheet operable to draw the sheet into tension in the shedding region. The rotor for each separate yarn sheet may be adapted to draw the yarns in that sheet into tension in each cycle of operation and to release the yarns during each shedding operation, an additional rotor being provided to act on the yarn sheet and operable to restrain the yarns in that sheet from being shed in selected cycles of operations.

The detent may alternatively take the form of a profiled belt moving across the or each warp yarn sheet.

Preferably the means for returning the warp yarn sheet to its original position after beating comprises means for mechanically displacing laterally a portion of the woven fabric adjacent the fell of the fabric into a path of predetermined length. Such means may take the form of a profiled belt, or of a rotor rotatable about an axis parallel to the direction of weft insertion and having a surface engaging the fabric and shaped so that on rotation the fabric is displaced by an amount dependent on the angular position of the rotor.

Figure 1B:
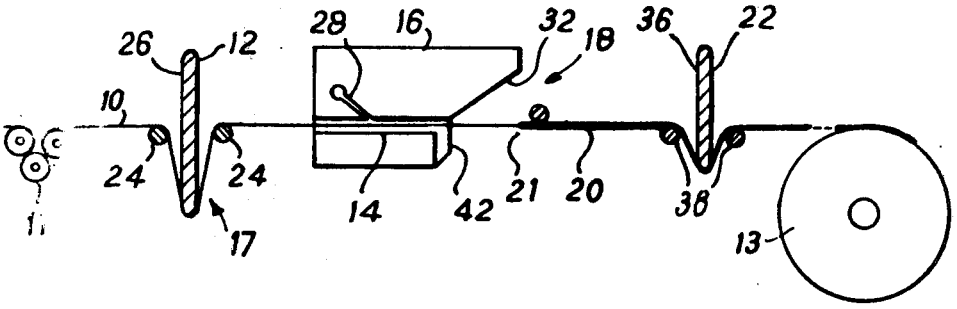
Figure 1C:
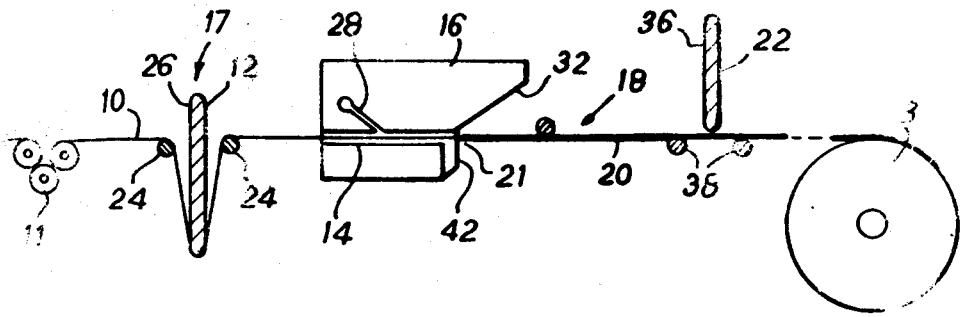
Figure 2:
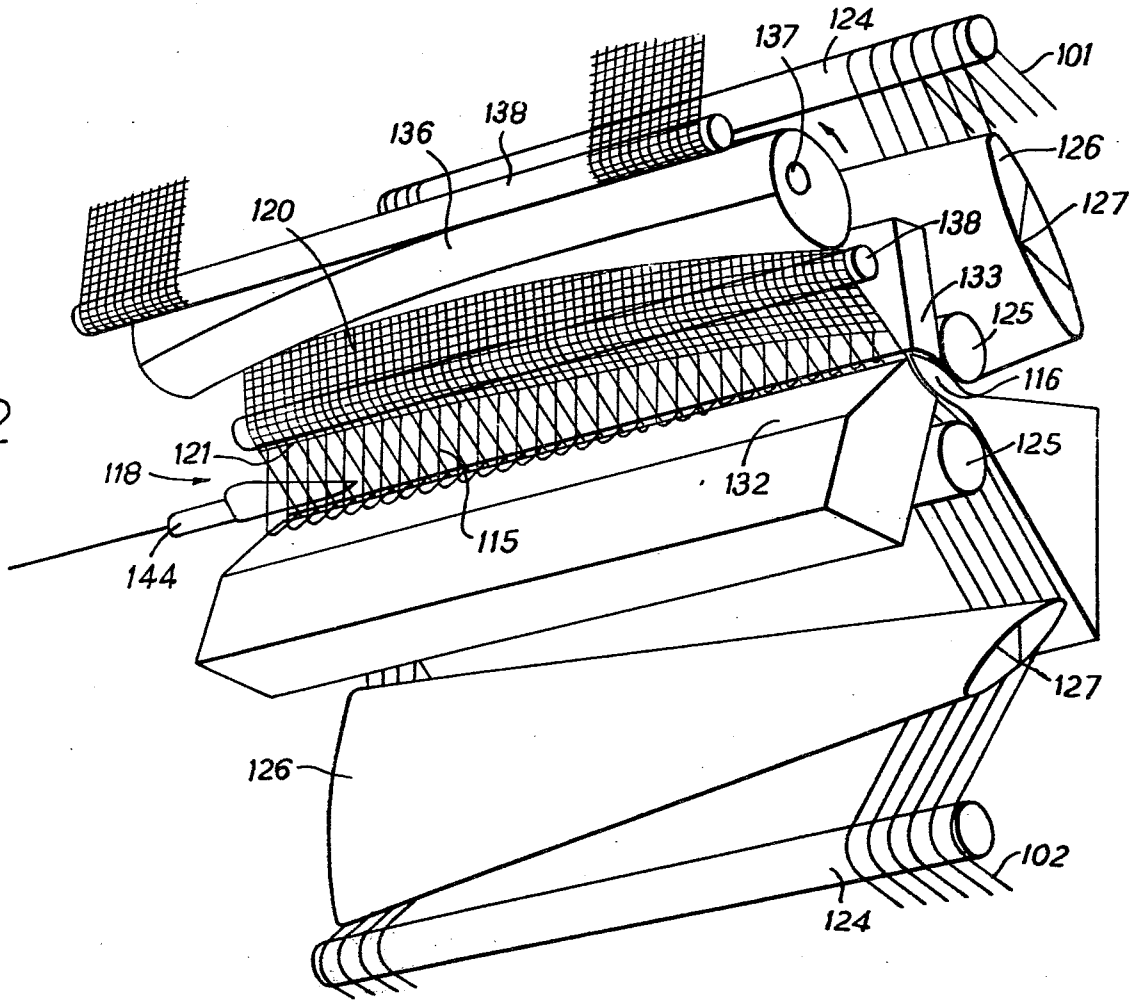
Figure 3:
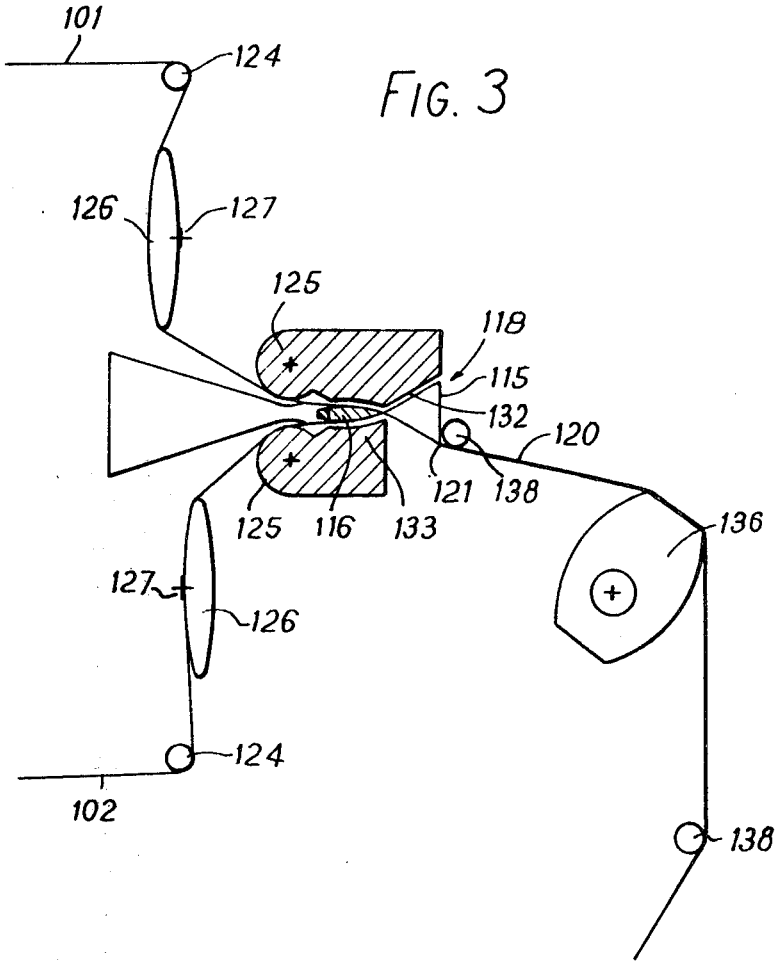
Figure 4:
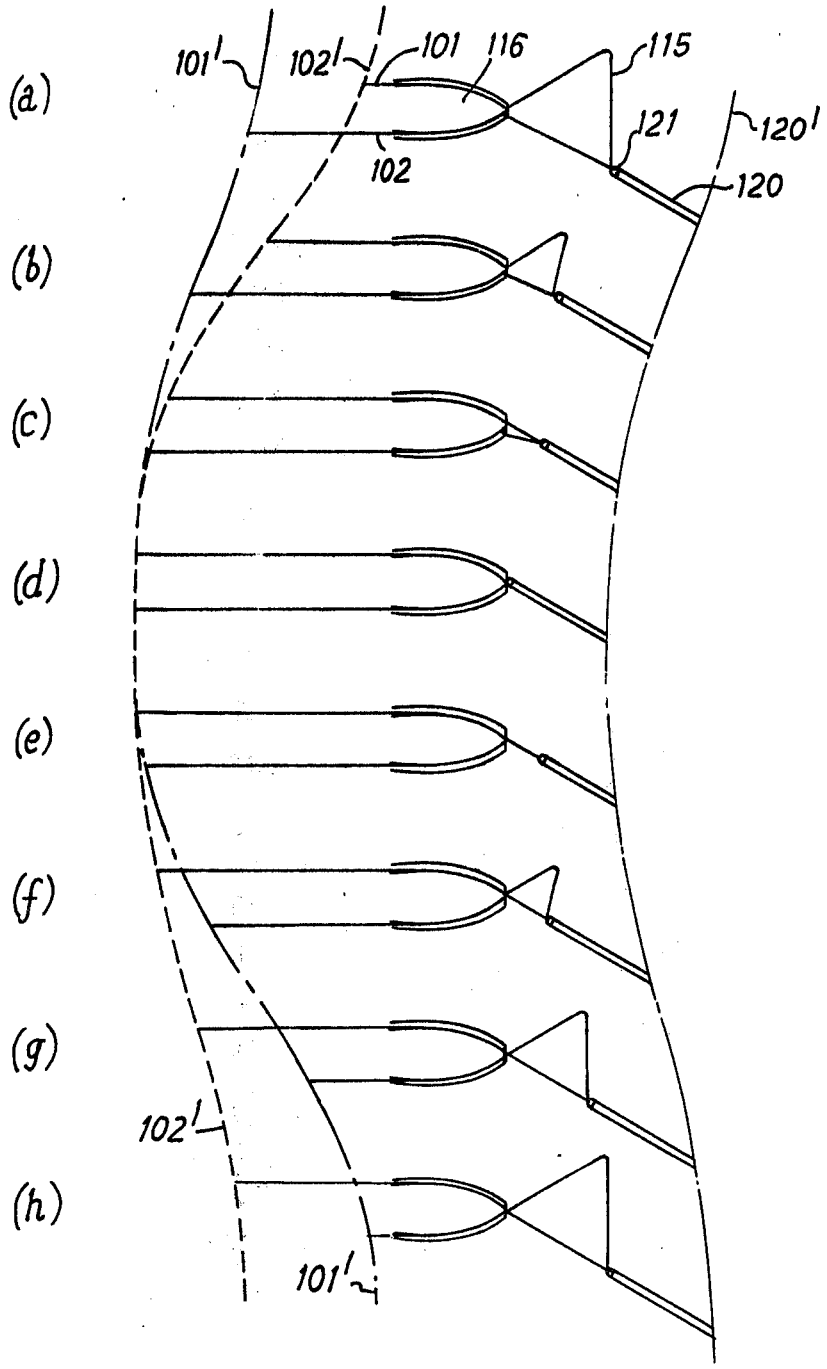
Figure 5:
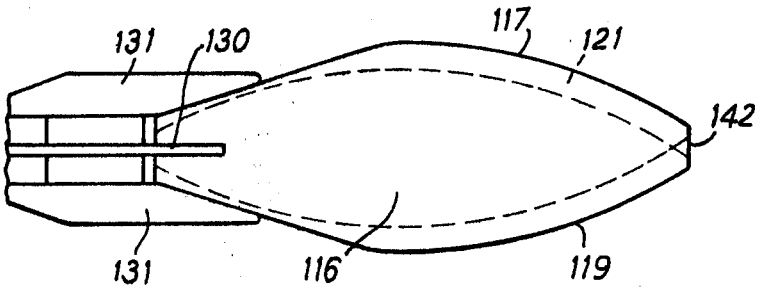
Figure 6:
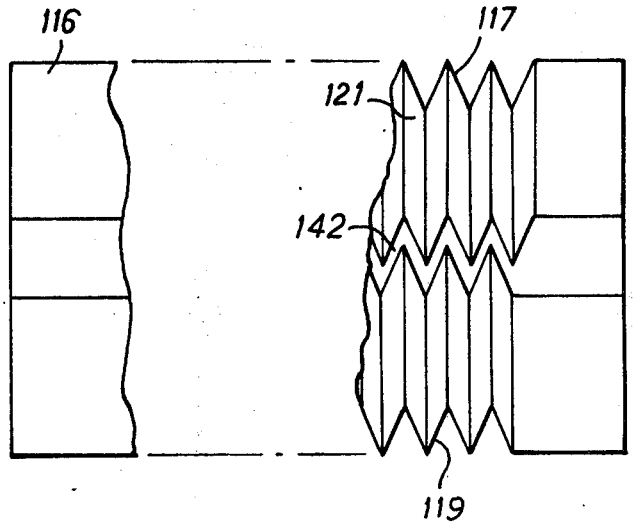
Figure 7:
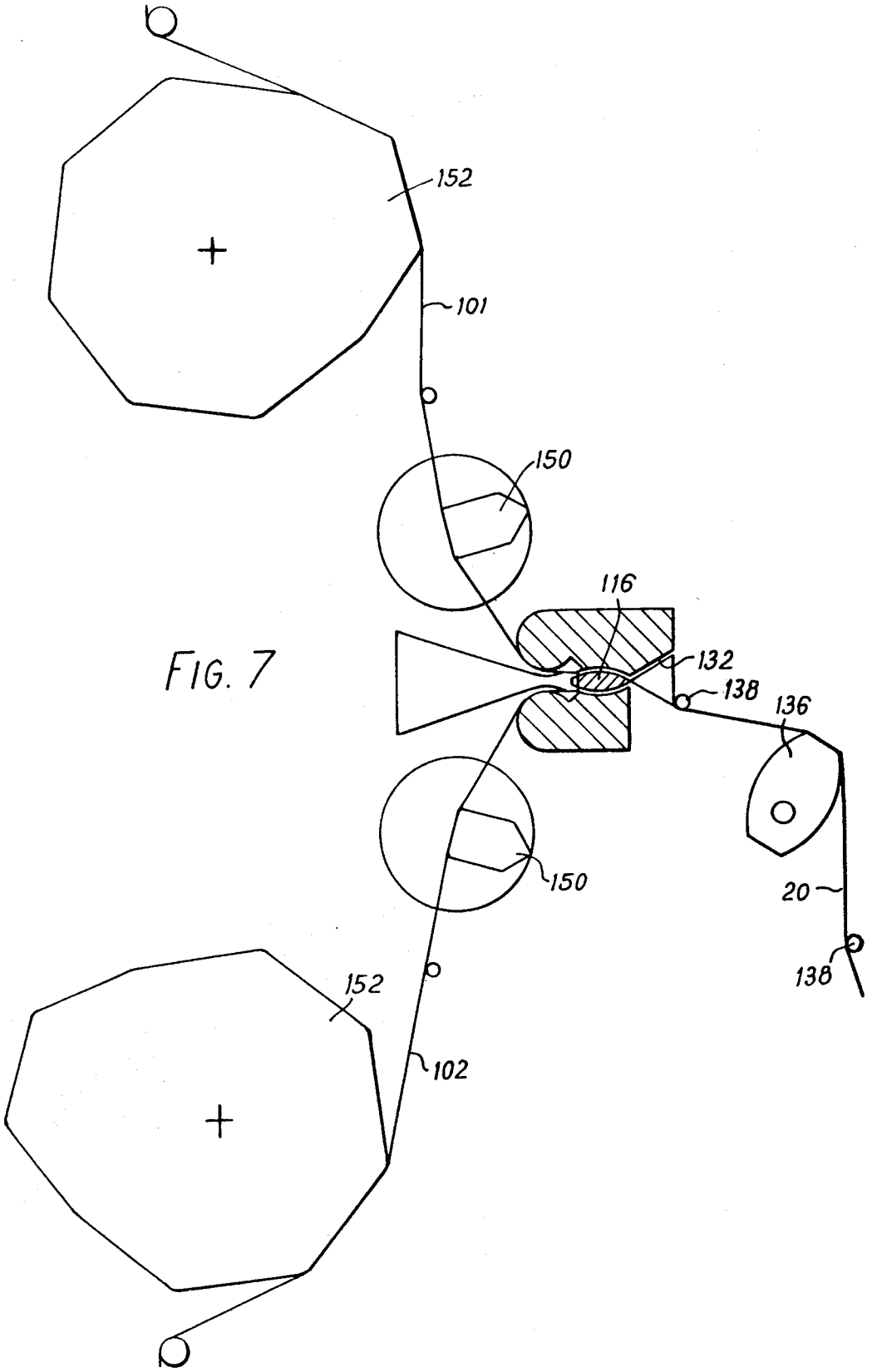
Figure 8:
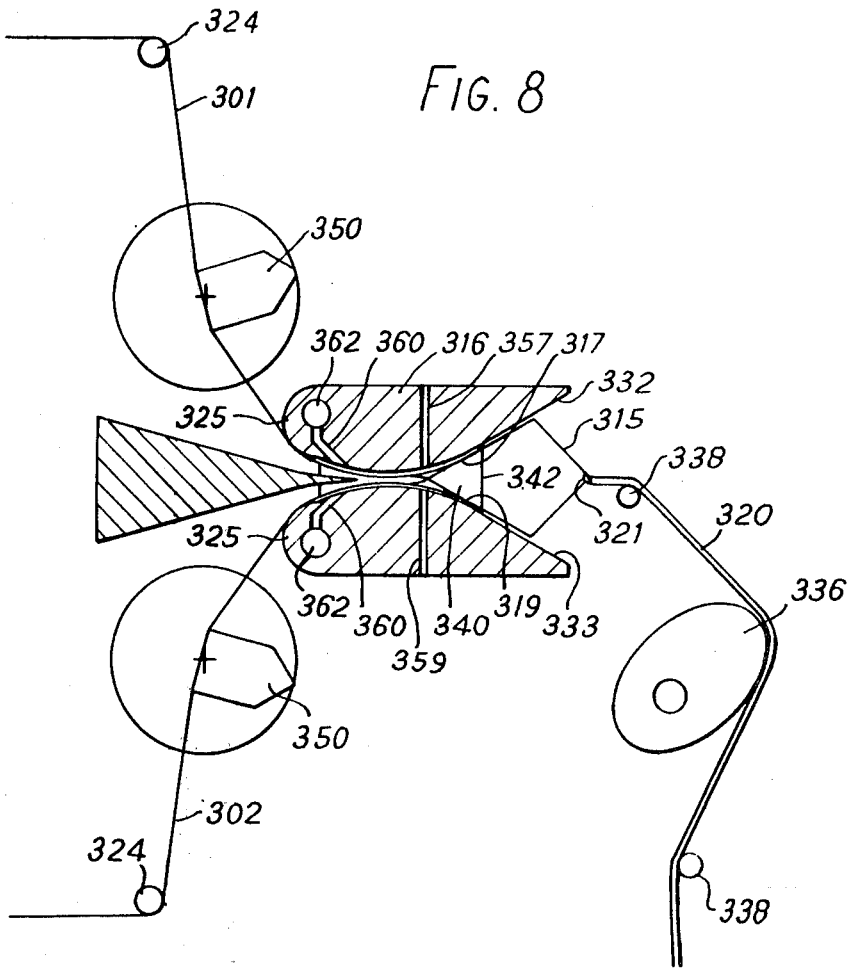
Figure 9:
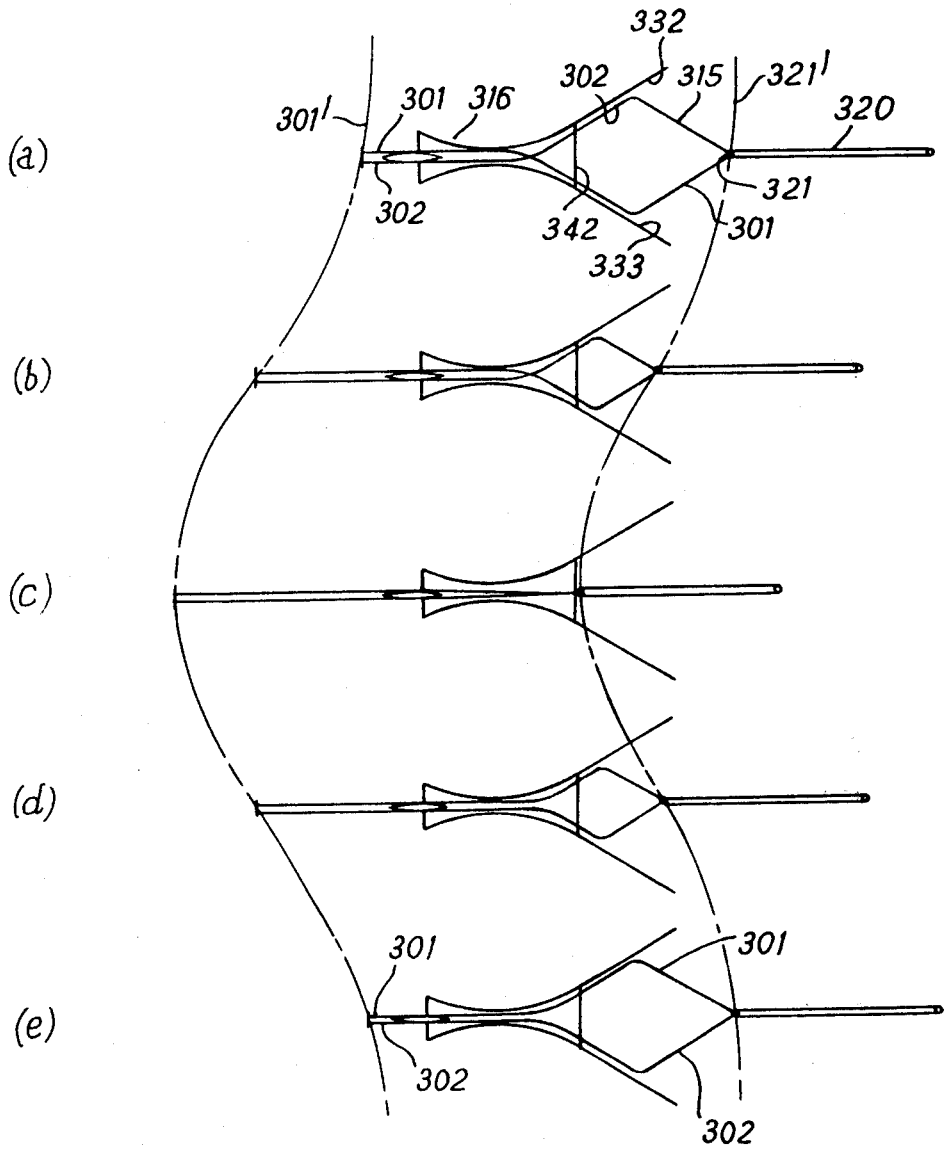

The invention will now be described, by way of example, with reference to the accompanying drawings, in which:

FIGS. 1*a* to 1*c* illustrate diagrammatically the movements of a single warp yarn in one form of the invention, FIG. 2 is a diagrammatic perspective view of one section of a plain-weave loom in accordance with one embodiment of the invention, FIG. 3 is a diagrammatic vertical cross section through the principal components of a loom similar to that of FIG. 2, FIG. 4 illustrates schematically the sequence of shedding and beating operations of the looms of FIGS. 2 and 3, FIG. 5 is a fragmentary side elevation, on a larger scale, of a fluidic element of the looms of FIGS. 2 and 3, and of the loom of FIG. 7, FIG. 6 is an end elevation, on a still larger scale, of the element of FIG. 5, FIG. 7 is a diagrammatic vertical section through a plain-weave loom according to a second embodiment of the invention, FIG. 8 is a diagrammatic vertical section through a loom according to a third embodiment of the invention, and FIG. 9 illustrates schematically the sequence of shedding and beating operations of the loom of FIG. 8.

FIGS. 1*a* to 1*c* illustrate diagrammatically the principal features of one form of loom in accordance with the invention, and show the path of a single warp yarn through the loom. The warp yarn 10 passes from feed rollers 11 via a yarn detent device 12 in a retraction region 17, through a channel or groove 14 in a fluidic element 16 and through or over a stationary reed 42 to a shedding region 18. The woven fabric 20 extends from the fell 21 at the edge of the shedding region 18, via a fabric detent device 22 to a suitable take-up roller 13. The Figures show the positions of the yarn 10 at instances during the principal stages of the weaving cycle, namely the shed formation stage (FIG. 1*a*), the shed closure stage (FIG. 1*b*) and the beating stage (FIG. 1*c*).

The yarn detent device 12 is shown diagrammatically as a pair of guide members 24 which engage one side of the warp yarn sheet, and a detent 26 which is movable between the guide members from the other side of the warp sheet. The detent can take the form of a rotor or a belt, as described below, or of a reciprocating element. In the shed formation stage (FIG. 1*a*) the detent 26 is withdrawn to its maximum extent from the guide members and engages the warp yarn 10 to a minimum extent, enabling a loop 15 to be formed in the yarn 10 in the shedding region, as described below. In the shed closure stage (FIG. 1*b*) the detent 26 projects between the guide members 24 so that the loop 15 is pulled back through the channel 14, and the portion of the yarn in the shedding region is drawn into tension, thereby closing the shed. In the beating stage (FIG. 1*c*) the detent 26 projects a further distance between the guide member, to draw the warp yarn and the fell of the fabric back a further predetermined distance against the reed 42.

Opening into the channel or groove 14 in the fluidic element 16 is a feed channel 28 through which air can be supplied under pressure so that the air flows along the channel or groove 14 and in doing so exerts, by momentum transfer, a longitudinal force on the yarn 10. When the yarn detent 12 is in the position shown in FIG. 1*a* the longitudinal force causes the yarn to move so that the loop 15 of yarn is formed in the shedding region. The air flow emerging from the mouth of the channel or groove 14 becomes attached to a surface 32 whose plane is inclined to that of the channel 14 and draws part of the loop of yarn to a position adjacent the surface 32, as shown in FIG. 1*a*, the loop thereby forming a shed for insertion of a weft yarn, e.g. by means of a weft carrier 44.

The fabric detent device 22 is shown in a form similar to the yarn detent device 12, having a detent 36 movable in opposition to a pair of guide members 38. The detent device 22 is positioned behind the fell 21 and therefore acts on the fabric which has already been woven. The detent 36 is shown in FIG. 1*c* withdrawn to its maximum extent, allowing the fell 21 to be drawn against the reed 42 to effect beating. FIGS. 1*a* and 1*b* shown show detent 36 having moved between the guides 38 thereby to draw the fell 21 from the reed 42 and element 16 to assist the formation of the shed.

In operation of the loom, the cycle of operations illustrated in FIGS. 1*a* to 1*c* is carried out in each warp yarn to be shed. Thus, with the detent devices 12 and 22 in the position shown in FIG. 1*a*, the warp yarn 10 is moved by fluidic forces as described above to form a shed into which a weft yarn is inserted by means of weft carrier 44. The yarn detent device 12 is then actuated to draw the warp yarn into tension in the shedding region to close the shed, as shown in FIG. 1*b*. The detent 26 continues moving with simultaneous movement of the detent 36 of the fabric detent device 22, to draw the fell of the woven fabric against the reed 42 to beat up the inserted weft yarn. The effective motions of the detents 26 and 36 are then reversed to draw the fell 21 away from the reed 42. If the warp yarn is to be shed to receive the next weft yarn to be inserted, the detents 26 and 36 then move back to the positions shown in FIG. 1*a* and the cycle is repeated. Shed selection in the loom can be effected by using the yarn detent device 12 to inhibit the longitudinal movement of the yarn which enables the loop 15 to be formed. Thus, if the warp yarn 10 is not to be shed for the next weft insertion, the detents 26 and 36 move from the positions of FIG. 1*c* to those of FIG. 1*b* and remain there during the next shedding operation. For example, with a plain-weave, in which each warp yarn is shed for every alternate weft insertion, each yarn will follow a repeating sequence shown by FIGS. 1*a*–1*c*–1*b*–1*c*. It will be apparent that for each pick it is necessary for selected warp yarns of the warp yarn sheet to be shed to the position shown in FIG. 1*a* whilst the remaining yarns in the sheet are held as described in the position shown in FIG. 1*b*. This can be done for example, in a plain-weave loom, by dividing the warp yarn sheet into two sheets containing alternate warp yarns and providing a separate detent 26 for each of the two sheets, as in the embodiment of FIGS. 2 to 4, the sequence of warp yarn movements being then as shown in FIG. 4.

Alternatively, shed selection can be effected by employing fluidic elements adapted to place part of the loop 15 of yarn to one side or other of the warp yarn sheet in dependence on a fluidic signal, as in the embodiment of FIGS. 8 and 9.

The rate of supply of yarn and rate of take-up of woven fabric by the feed rollers 11 and take-up roller 13 are controlled to regulate the tension in the warp yarns at beat-up of the woven fabric.

FIG. 2 is a diagrammatic perspective view of a short section of a plain-weave, wave shedding loom in accordance with one embodiment of the invention, and FIG. 3 is a vertical cross-section through the principal components of a similar loom. The warp yarn sheet is divided into two separate sheets 101 and 102 containing alternate warp yarns. The yarns of each warp sheet pass over a guide roller 124, and then extend round a rotor 126 rotatable about an axis 127 and forming part of the yarn detent device and around a guide 125 to a fluidic element 116, which is described in more detail below. The yarns then pass through the shedding region 118 to the fell 121 of the woven fabric 120. The fabric 120 passes over two guides 138 between which is a rotor 136 rotatable about an axis 137 and forming the fabric detent device.

As shown in FIGS. 5 and 6, the fluidic element 116 comprises a spade-shaped element having two convex corrugated surfaces 117 and 119. The corrugations in each surface are formed by parallel V-section grooves 121, each of which receives a single warp yarn, the yarn entering the groove tangentially to the convex surface. The yarns of warp sheet 101 pass over surface 117, whilst those of warp sheet 102 pass over surface 119, the grooves in surface 117 being transversely staggered with respect to those of surface 119 by half the pitch of the grooves.

The two surfaces 117 and 119 meet at one end of the fluidic element 116 in such a manner as to form a zig-zag surface 142 lying in the plane perpendicular to the plane of symmetry of element 116 and defined between the edges of the grooves 121 on the two surfaces. The zig-zag surface 142 acts as a stationary reed against which the fell of the woven fabric can be drawn, by operation of the rotors 126, during the beating operation.

The element 116 is supported by a plate 130, and two covering plates 131 are positioned on either side of the plate 130 to define a manifold through which air under pressure can be supplied to the surfaces 117 and 119. Each of the plates 131 extends a short distance over the grooves of the adjacent surface 117 or 119 so that the front edge of each plate co-operates with the grooves in that surface to form a series of nozzles from which the air is directed to the grooves. Air is supplied continuously to the surfaces so that the air flows along the grooves 121 and applies force by momentum transfer to the yarns in the grooves. The air streams from the two surfaces combine at the junction of surfaces 117 and 119 and the resulting flow becomes attached by Coanda effect to a surface 132 inclined to the plane of symmetry of the element 116. The attachment of the air flow to the surface 132 is assisted by a deflector 133 positioned on the opposite side of the plane of symmetry. The air flow separates from the warp yarn sheet the loops 115 of yarn formed in the shedding area, to form a shed.

Each of the rotors 126 is shaped so that as it rotates continuously at uniform speed each of the yarns it engages is moved in the manner described above with reference to the detent 26 of the yarn detent device 12 in FIG. 1. Similarly, the rotor 136 is shaped so as to move the fabric 120 in the same manner as the detent 36 of the fabric detent device 22 in FIG. 1. In operation, the warp yarns from the two warp sheets 101 and 102 are shed alternately, the rotor associated with the sheet whose yarns are not shed acting to hold the yarns in tension in the shedding area during the shedding operation. The rotors 126 are therefore rotated at half the speed of the rotor 136.

The movement of the warp yarns and the fell during each weaving cycle is illustrated schematically in FIG. 4, in which the line 101' indicates the displacement of a point on a warp yarn of sheet 101 due to the movement of the corresponding yarn detent rotor 126 (disregarding the small movement due to the feed of the yarns from the feed rollers and take-up of woven fabric by the take-up roller), line 102' similarly indicates the displacement of a yarn in warp yarn sheet 102, and line 120' indicates the displacement due to movement of the fabric detent rotor 136 of a point in the woven fabric between the rotor 136 and the fell 121. The sequence of events illustrated is as follows:

(a) A shed is formed in the yarn sheet 101, the yarns of that sheet being moved by pneumatic forces in element 116 to form loops 115 in the shedding region, whilst the yarns of yarn sheet 102 are held taut in the shedding region by the corresponding rotor 126. A weft yarn is inserted.

(b) The yarn 101 is drawn back through element 116 by the corresponding rotor 126 so that the shed begins to close. At the same time the yarn 102 is drawn back at a slower rate by the corresponding rotor 126 and the rotor 136 synchronously releases the fabric so that the fell 121 begins to move towards the element 116.

(c) Both yarns 101 and 102 are now in tension in the shedding region so that the shed is closed.

(c) to (d) Both yarns are drawn back further at the same speed, so that the fell 121 is drawn against the element 116 which applies a beating force to beat up the inserted weft yarn.

(d) to (e) The fabric detent rotor acts on the fabric to draw the fell 121 away from the element 116. The rotors 126 release both warp yarns 101 and 102 at the same rate so that both yarns are held in tension until the fell 121 has moved far enough from the element 116 to enable separation of yarn 102 from the warp yarn sheet to begin.

(f) Warp yarn 101 is held in tension in the shedding area whilst the yarn 102 is released more rapidly by the corresponding rotor 126, to enable a loop 115 to form in the shedding region. Part of the loop is drawn adjacent surface 132 by the air flow emerging from the grooves in surfaces 117 and 119 of element 116; the air flow penetrates the warp yarn sheet in the shedding region, thus facilitating the separation of the yarns 102 from the yarn sheet in the shedding region.

(g) to (h) The movement of yarn 102 continues until the shed is fully open to receive the next weft yarn.

The cycle then continues with the closure of the shed and the subsequent opening of the next shed in warp yarn sheet 101; the sequence of events in this part of the cycle can be seen by following the stages shown in FIG. 4 in the reverse order, from (h) to (a).

To effect the shedding and beating operations in a travelling wave motion across the loom, the rollers 126 and 136 have a generally helical shape. Thus each of the stages of the weaving cycle shown in FIG. 4 takes place at a later instant in each successive section of the loom as the wave motion traverses the loom, and the fell of the fabric at any instant will take up an undulating profile, which may be represented by a repeating sequence of the profile shown in line 120' in FIG. 4.

It will be appreciated that the movements of the warp yarns and of the fell of the woven fabric need not correspond precisely to those shown in FIG. 4. The shapes of the rotors 126 and 136 can be chosen to control the movements of the yarns and fabric and the distribution of tensions in the yarns and fabric in any desired manner appropriate to the type of yarn employed and of fabric being woven.

In FIG. 2 a weft insertion device 144 is shown. It will be apparent that weft insertion could be carried out in any suitable manner, e.g. by means of belt-driven weft carriers such as are used in known travelling wave shed looms or by magnetically levitated weft carriers propelled electromagnetically through the shed as described in United Kingdom patent specification No. 1,436,541.

FIG. 7 shows a second embodiment of the invention which is similar to the embodiment of FIGS. 2 to 6 except that each yarn detent rotor 126 is replaced by a pair of rotors 150 and 152, each pair of rotors acting on one of the warp yarn sheets 101 or 102. Each rotor 150 is shaped to effect the drawing back of the corresponding warp yarns after shedding and the release of the yarns to allow a loop to be formed in the shedding region, the two rotors 150 rotating in synchronism at the same speed as the fabric detent rotor 136. Each of the rotors 152, which rotate at half the speed of rotor 136, is shaped to hold the yarns in tension in every alternate cycle during the period in which the yarns would otherwise be released by rotor 150 to form a shed, whilst releasing the yarns to allow them to be shed in the remaining cycles. The motion of the warp yarns produced by the combined action of each pair of rotors 150 and 152 is accordingly the same as the motion produced by each single rotor 126 in the embodiment of FIGS. 2 to 6, but the function of inhibiting shedding of warp yarns to achieve the necessary shed selection is given to the rotor 152 and is effectively separated from the function of moving the warp yarns.

The embodiment of FIG. 7 could be modified by separating the warp yarn sheet into three or more rather than two separate sheets and providing a third rotor or corresponding rotors similar to rotor 152 around which one of the separate yarn sheets is drawn before passing over one of the rotors 150. The three rotors 152 would be shaped to produce the desired shedding sequence for the yarns of the three warp yarn sheets to produce a desired twill weave pattern. It will be appreciated that further inhibit rotors 152 could be provided to control the shedding selection of yarns sequentially in a corresponding number of warp yarn sheets.

FIG. 8 illustrates a third embodiment in which shedding selection is effected by pneumatic means rather than by using the detents acting on the warp yarns to inhibit shedding of yarns in one of the yarn sheets. This embodiment employs a fluidic element 316 having two convex surfaces 317 and 319 which face towards one another, the yarns from two warp yarn sheets 301 and 302 passing between the surfaces. Each surface is provided with parallel V-section grooves, similar to those of the element 116 of FIGS. 5 and 6, which can receive warp yarns. Opening into each of the surfaces is a slit 360 through which air under pressure can be supplied, from a manifold 362, so that air flows through the grooves in the surface to apply force by momentum transfer to yarns in the grooves. An inclined surface 332 extends from surface 317 and a similar surface 333 extends from surface 319. Selected pairs of adjacent grooves in each of the surfaces 317 and 319 are separated by shims 340, each of which extends from one surface to the other. A number of separate ports 357 open one into each groove in the surface 317, and similarly a number of ports 359 open into the grooves in surface 319. By supplying air under pressure to the port 357 opening into one of the grooves in surface 317 whilst no air is supplied to the port 359 opening into the corresponding groove in surface 319, the combined air flow emerging from the two grooves is made to attach itself to the surface 333, so that a yarn lying in either groove will, when loop 315 is formed in the shedding region, be drawn alongside surface 333. Similarly, if air is supplied to port 359 and the air supply to port 357 cut off, the air flow is switched to attach itself to surface 332, so that the yarn will be drawn alongside that surface. Accordingly, by controlling the air supply to the ports 357 and 359, the loop 315 formed in each yarn in the shedding region can be placed to one side or other of the plane of the taut warp yarn sheet.

Since the shed inhibiting function of the yarn detent devices is not required in this embodiment, each yarn detent device comprises a rotor 350, similar to the rotor 150 of the embodiment of FIG. 7, acting between guides 324 and 325. A fabric detent rotor 336 acts on the fabric 320 between guides 338. The rotors 350 rotate in synchronism at the same speed as rotor 336, so that the yarns 301 and 302 are released simultaneously to allow loops 315 to be formed and then drawn back simultaneously to close the shed and to draw the fell 321 of the woven fabric back against the reed formed by the forward edges 342 of the shims 340, to beat up the inserted weft yarn.

The sequence of events in a cycle of operation of the loom of FIG. 8 is shown in FIG. 9, line 301' indicating the displacement of both the warp yarns 301 and 302 and line 321' indicating the displacement of the fell 321. At stage (a) the shed is fully open, with yarn 301 placed at the lower side of the shed, the yarn emerging from its groove in the surface 317 to lie alongside surface 333, and yarn 302 placed at the upper side of the shed. Stages (b) and (c) show the yarns being simultaneously drawn back to close the shed and draw the fell of the woven fabric against the reed. Stages (d) and (e) show the fell drawn back from the reed by the action of the fabric detent rotor and the yarns released to enable the next shed to be formed, the pneumatic signals to the control ports 357 and 359 of element 316 having being switched so that the yarn 301 is now placed at the upper side of the shed whilst the yarn 302 is placed at the lower side of the shed.

It will be apparent that the use of pneumatic signals to control shedding selection in this embodiment gives great flexibility to that control. For example, fully programmed shedding control, in the manner of a Jacquard loom, could be effected, e.g. by using electronic or pneumatic logic control circuits to control the supply of air to the control parts of the fluidic element, or using control means such as those disclosed in United Kingdom patent specification No. 1,436,541.

It will be appreciated that the control of the air flow in the shedding region of the loom of the invention, both to effect the separation of yarns from the warp yarn sheet and, where fluidic signals are to be used to control shedding selection, to control the placing of yarns to one side or other of the warp yarn sheet, could be achieved in various ways by suitably designing the fluidic elements. For example, any one of the fluidic elements shown in United Kingdom patent specification No. 1,436,541 could be used.

The yarn detent devices and fabric detent devices could take forms other than the rotors described. For example, the movable detent 26 of the yarn detent device 12 shown in FIG. 1 could take the form of an endless belt one run of which extends across the loom with its plane perpendicular to that of the warp yarn sheet, the edge of the belt engaging the warp yarns being profiled to give the appropriate movement perpendicular to the warp yarn sheet of the point of contact between the belt and each yarn as the belt moves across the loom at a constant speed. The detent 36 of the yarn detent device 22 could similarly take the form of a belt.

In place of the stationary reed of the described embodiments, various forms of movable reed, such as a rotating reed, could be used. In that case, since the movement of the fell of the woven fabric towards and away from the stationary reed would no longer be necessary, the fabric detent device could be omitted.

We claim:

1. A loom comprising means for feeding a plurality of warp yarns to a shedding region and take-up means for drawing woven fabric from the shedding region, each warp yarn passing through a retraction region and the shedding region, means for creating gaseous fluid flow along one or more portions of each of the warp yarns so that unrestrained yarns along which the fluid flow is created are moved longitudinally in a first direction to form a loop in each of those yarns in the shedding region, and means for mechanically displacing portions of warp yarns in the retraction region thereby to move the yarns longitudinally in a second direction into a path of predetermined length to draw the yarns into tension in the shedding region, means for separating the loops of yarn from the warp yarn sheet in the shedding region to form a shed for the insertion of a weft yarn, weft insertion means for inserting a weft yarn into the shed, and bearing means for beating the inserted weft yarn against the fell of the woven fabric.

2. A loom as claimed in claim 1, in which the means for creating gaseous fluid flow is adapted to create fluid flow simultaneously along the warp yarns in at least one section of the loom during a shedding operation, and there is provided a plurality of means for mechanically displacing portions of selected warp yarns each arranged to act on a group of the warp yarns during the shedding operation thereby to inhibit shedding of the yarns in that group.

3. A loom as claimed in claim 1, in which the means for creating gaseous fluid flow is adapted to create fluid flow simultaneously along all the warp yarns in at least one section of the loom during a shedding operation thereby to form loops in all the warp yarns in the shedding region, in the said one section and shedding control means are provided to control the means for separating warp yarn loops from the yarn sheet in the shedding area so that in each cycle of operation selected ones of the warp yarn loops are positioned on one side of the plane defined by the tensioned warp yarns, whilst the remainder of the warp yarns are positioned on the opposite side of that plane, thereby to form a shed.

4. A loom as claimed in claim 1, in which the means for separating the warp yarn loops in the shedding area from the warp yarn sheet comprises means for controlling gaseous fluid flow in the shedding area so that the fluid flow acts on the loops to separate them from the warp yarn sheet.

5. A loom as claimed in claim 1, in which the means for creating gaseous fluid flow along one or more portions of each of the warp yarns to be moved comprises channels through which the warp yarns pass and inlet ports opening into the channels in such a manner that supply of fluid under pressure to the inlet ports causes flow of fluid in the first direction through the channels.

6. A loom as claimed in claim 1, in which the means for creating gaseous fluid flow along one or more portions of each warp yarn comprises an element having at least one surface formed with parallel grooves each adapted to accommodate a warp yarn and means for supplying fluid to the grooves to create fluid flow along the grooves in the said first direction.

7. A loom as claimed in claim 6, in which each groove is V-shaped in cross-section.

8. A loom as claimed in claim 6, in which there are provided at least two similar grooved surfaces and in which the grooved surfaces face towards one another, the warp yarns in use passing between the two surfaces, and in which shedding control means are provided to control the gaseous fluid flow emerging from the grooves so that in each cycle of operation the loops in selected ones of the warp yarns in at least one section of the warp yarn sheet are moved to one side of the plane defined by the tensioned warp yarns whilst the loops of the remaining warp yarns in that section are moved to the opposite side of that plane, thereby to form a shed.

9. A loom as claimed in claim 8, in which the shedding control means includes a plurality of control ports, one opening into each of the grooves near the end of the groove adjacent the shedding region so that application of a fluidic signal through the control port controls the fluidic flow in the shedding region to cause the yarn lying in the corresponding groove to be separated from the plane of the warp sheet on the side of the said plane determined by the fluidic signal.

10. A loom as claimed in claim 1, in which the shedding operation is timed to occur successively in adjacent sections of the loom so that the shedding operation travels in a wave-like motion across the loom.

11. A loom as claimed in claim 1, in which the beating means comprises a reed through or over which the warp yarns pass, and means for mechanically displacing portions of the warp yarns in a region remote from the shedding region into a path of predetermined length, after warp yarns been drawn into tension in the shedding region, thereby to move the warp yarn sheet so as to drawn the fell of the woven fabric against the reed to beat the inserted weft yarn, and there are provided means for returning the fell to its original position after the beating operation.

12. A loom as claimed in claim 11, in which there is provided an element having on opposite sides thereof two surfaces each formed with parallel grooves each adapted to accommodate one of the warp yarns, the grooves in each surface being transversely staggered relative to the grooves in the other surface and being arranged to receive alternate ones of the warp yarns, and in which the two grooved surfaces meet one another in such a manner as to form a narrow zig-zag face extending transversely across the loom and forming the reed against which the fell of the fabric is drawn to beat up the inserted weft yarn.

13. A loom as claimed in claim 11, in which the reed is stationary.

14. A loom as claimed in claim 13, in which the reed is formed by walls dividing adajcent ones of channels or grooves through which the warp yarns pass, the fell of the fabric being drawn in use against edges of portions of the walls extending from the mouths of the channels or grooves into the shedding region.

15. A loom as claimed in claim 13, in which the means for displacing portions of the warp yarns to effect beating is incorporated in the means for displacing portions of selected warp yarns to draw the yarns into tension in the shedding area, the said means being adapted, after displacing the portions of the warp yarns to draw the yarns into tension in the shedding area, to displace the portions by a further predetermined amount to effect the beating.

16. A loom as claimed in claim 15, in which the warp yarn sheet is divided into a plurality of separate yarn sheets each containing selected warp yarns and each acted upon by a separated means for drawing the warp yarns into tension in the shedding region, the means for creating gaseous fluid flow along the warp yarns being adapted to act simultaneously on the yarns in all the yarn sheets in at least one section of the loom and each of the means for drawing the warp yarns into tension being operable to retain the warp yarns in the associated sheet during a shedding operation thereby to inhibit shedding of the yarns in that sheet.

17. A loom as claimed in claim 11, in which the means for returning the warp yarn sheet to its original position after beating comprises means for mechanically displacing laterally a portion of the woven fabric adjacent the fell of the fabric into a path of predetermined length.

18. A loom as claimed in claim 17, in which the means for mechanically displacing laterally a portion of the woven fabric adjacent the fell comprises a rotor rotatable about an axis parallel to the direction of weft insertion and having a surface engaging the fabric and shaped so that on rotation the fabric is displaced by an amount dependent on the angular position of the rotor.

19. A loom as claimed in claim 1, in which the or each means for mechanically displacing portions of the selected warp yarns comprises a pair of guide members spaced apart along the length of the yarns and over which each of the yarns is drawn, and a movable detent adapted to engage each of the warp yarns at a point between the two guide members and to move each yarn out of the warp yarn sheet to create a loop of yarn of predetermined length between the guide members.

20. A loom as claimed in claim 19, in which the detent comprises a rotor rotatable about an axis parallel to the direction of weft insertion and having a surface engaging the warp yarns and shaped so that on rotation each warp yarn is displaced by an amount dependent on the angular position of the rotor.

21. A loom as claimed in claim 20, in which the warp yarn sheet is divided into a number of separate yarn sheets, and a separate rotor is provided for each yarn sheet operable to draw the sheet into tension in the shedding region.

22. A loom as claimed in claim 20, in which for each separate yarn sheet the said rotor is adapted to draw the yarns in that sheet into tension in each cycle of operation and to release the yarns during each shedding operation, and an additional rotor is provided to act on the yarn sheet and operable to restrain the yarns in that sheet from being shed in selected cycles of operations.

23. A loom as claimed in claim 20, and arranged as a travelling wave loom in which the shedding operation and beating operations are carried out in turn on successive sections of the warp yarn sheet, the shedding operation progressing synchronously with the beating operation and travel of one or more weft carriers across the sheet.

24. A loom as claimed in claim 23, in which each rotor is generally helical in shape.

* * * * *